United States Patent [19]

Hoelzl

[11] Patent Number: 4,740,009

[45] Date of Patent: Apr. 26, 1988

[54] SKI, IN PARTICULAR A CROSS-COUNTRY SKI

[75] Inventor: Klaus Hoelzl, Vienna, Austria

[73] Assignee: TMC Corporation, Baar, Switzerland

[21] Appl. No.: 735,422

[22] Filed: May 17, 1985

[30] Foreign Application Priority Data

May 18, 1984 [AT] Austria ..... 1657/84

[51] Int. Cl.[4] ..... A63C 5/07

[52] U.S. Cl. ..... 280/602

[58] Field of Search ..... 280/602, 609, 615

[56] References Cited

U.S. PATENT DOCUMENTS

| | | | |
|---|---|---|---|
| 4,140,331 | 2/1979 | Salomon | 280/612 |
| 4,156,534 | 5/1979 | Salomon | 280/612 |
| 4,280,714 | 2/1977 | Salomon | 280/611 |
| 4,468,049 | 8/1982 | le Faou et al. | 280/634 |

FOREIGN PATENT DOCUMENTS

| | | | |
|---|---|---|---|
| 2014935 | 10/1971 | Fed. Rep. of Germany . | |
| 2833393 | 2/1980 | Fed. Rep. of Germany . | |
| 8301597 | 6/1983 | Fed. Rep. of Germany . | |
| 3315638 | 12/1983 | Fed. Rep. of Germany | 280/602 |
| 1304880 | 1/1963 | France | 280/602 |

*Primary Examiner*—John J. Love
*Assistant Examiner*—Richard Lamby
*Attorney, Agent, or Firm*—Flynn, Thiel, Boutell & Tanis

[57] ABSTRACT

An apparatus for facilitating optimum adjustment of a cross-country ski, the bending resistance and/or arch of which can be adjusted, includes a sensor connected to a control circuit, and the control circuit is in turn connected to either a drive mechanism which automatically controls the adjustment of the ski or to an indicating device which visually indicates the necessary adjustment to be made manually. The control circuit monitors ski performance at a given adjustment for a predetermined interval, thereafter determines an appropriate adjustment, then monitors ski performance at the new adjustment for the predetermined interval, and so forth. A gearing mechanism powered manually or by an electric motor can be provided to effect the automatic adjustment of the ski in response to an output of the control circuit.

36 Claims, 17 Drawing Sheets

SKI, IN PARTICULAR A CROSS-COUNTRY SKI

FIELD OF THE INVENTION

This invention relates to a ski, and more particularly to a cross-country ski having a bending resistance and/or arch which can be adjusted.

BACKGROUND OF THE INVENTION

A known ski of this type French Pat. No. 1 304 880 consists either of a metallic hollow profile, in which a sheet-metal strip which extends longitudinally of the ski is supported for adjustment perpendicular to the running surface of the ski, or of two belts which are separated from one another by a layer of a rubber-elastic material. In both cases, in order to change the bending resistance of the ski, slotted bolts or cap nuts with a slot are provided and must be adjusted manually. Such an adjustment can easily lead to errors, since the snow conditions may possibly change during skiing. It is therefore practically impossible to at all times have the ski adjusted for the optimum value of the bending resistance of the ski.

According to Austrian Patent Application No. A 2633/83, the arch can be changed in a cross-country ski by the running coating or base being loosely supported on the ski member in the area of the middle third of the ski and being able to be moved away from the ski member by means of pressure screws.

In Austrian patent Application No. A 425/84 (corresponds to U.S. Ser. No. 700,259 filed Feb. 11, 1985), a cavity is provided in the cross-country ski and extends longitudinally of the ski, in which cavity a transverse beam is supported at its two ends. The transverse beam carries in its center a pin which is associated with a slide member equipped with a sloped surface. The abutment can be positioned to have a pregiven distance from the end of the pini, can engage the end of the pin, or can pretension the transverse beam through the pin. Depending on which of these three cases exists, the bending resistance or arch of the ski changes during the use of the ski.

However, the direction in which the ski adjusting mechanism should be adjusted is not indicated in these solutions. The correct adjustment of the ski is thus made difficult.

SUMMARY OF THE INVENTION

A purpose of the invention is to bring about a preferably automatic optimizing of the stiffness or arch of the ski for different snow conditions and for the particular physique, weight and skiing style of the user. The invention uses thereby the optimizing principle of the trial and error method. This method, applied to the present filed, substantially involves the ski being measured, during skiing with a given adjustment, according to criteria which are important for skiing, thereafter being changed by a pregiven amount in its adjustment, and thereafter being again measured in the new adjustment according to the same criteria. Through a comparison of the results of the two measurements it can be determined whether the adjustment of the ski has improved or degraded its skiing characteristic. If through the adjustment an improvement of the skiing characteristics has resulted, then the ski is adjusted further in the same direction, whereas in the case of degradation, the direction of the adjustment is reversed and at the same time the adjusting step is reduced, for example cut in half.

This method leads to a step-by-step optimization of the ski, and is continued until a further adjustment of the ski would not lead to a significant improvement of its skiing characteristic. Because of the reduction of the size of each adjustment step, which reduction is effected with each change in the direction of the adjustment of the ski, it will generally be sufficient to specify a specific number of direction changes for the adjustment, after which the optimizing method can be stopped.

Since the judging of the ski through measuring processes occurs during the skiing of the skier, it is advantageous to consider statistic viewpoints during the measuring of the ski in every adjustment, for example by using a specified number of cross-country skiing steps of the skier for the respective measurement. Through this, subjective influences of the skier (such as irregularities in skiing style or similar factors) are as much as possible taken into account during the judging of the skiing characteristics of the ski.

The set purpose is attained inventively by providing an electronic control circuit which is powered by a power source and is connected to at least one measuring device or also to at least one signal generator which can preferably be operated by a foot of the skier, an output of the control circuit being connected either to an indicating device for facilitating manual adjustment and/or to a drive mechanism for facilitating semi or fully automatic adjustment of the bending resistance and/or arch of the ski.

BRIEF DESCRIPTION OF THE DRAWINGS

The invention will be discussed in greater detail hereinafter in connection with the drawings, in which.

DETAILED DESCRIPTION

Figure 1:
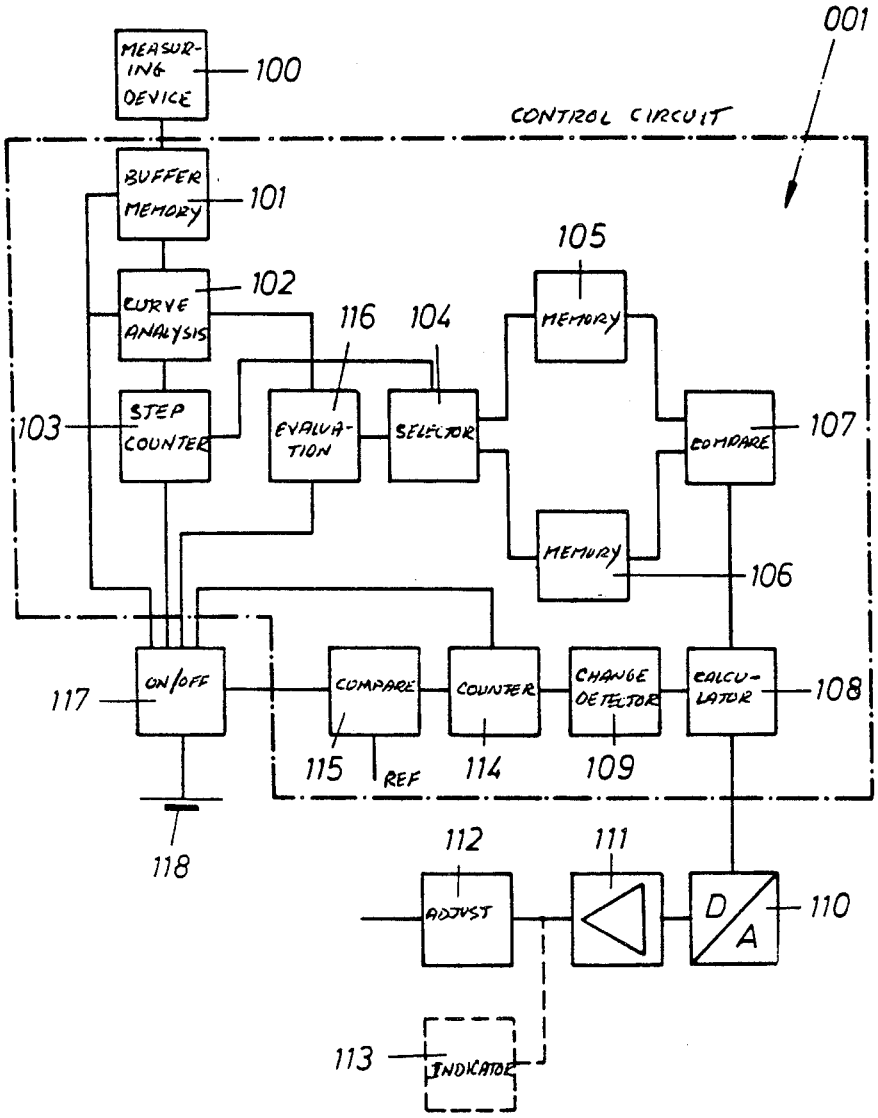
FIG. 1 illustrates a block diagram of a first embodiment of a circuit embodying the invention.

FIG. 1 illustrates a first embodiment of a circuit in which a control circuit 001 is connected to a measuring device or sensor 100, the control circuit being surrounded by dash-dotted lines for clarity and being described hereinafter. A buffer memory 101 is connected to an output of the sensor 100 as a first structural element. A curve analysis element 102 for curve analysis follows the buffer memory 101 and is associated with step counter 103, which counts the number of cross-country skiing steps. A line leads from the step counter 103 to a selector 104, which is controlled by the step counter 103 and feeds data to two memories 105 and 106. The values which are stored in the two memories 105 and 106 are compared in a comparison element 107, and the result is fed to a calculator 108. From the result of the comparison, the calculator 108 calculates the direction and size of a change in the adjustment of the ski which is to be carried out. A direction change detecting element 109 recognizes whether the direction of the change in ski adjustment corresponds with the preceeding adjustment or is opposite thereto, the usefulness of which will be discussed later on, and is connected at one end to the calculator 108. A digital to analog converter 110, which is not part of the control circuit 100, is also connected to the calculator 108. A line leads from the digital to analog converter 110 through an amplifier 111 to a correcting element 112 or to an indicating device 113. A counter 114 is provided for counting the number of direction changes of the adjusting device, and a comparison element 115 for comparing this number with a predetermined reference value is connected to an output of the element 109.

Furthermore, the element 102 for curve analysis is connected to an evaluating element 116, the design of which will be discussed hereinafter. The buffer memory 101, the element 102 for curve analysis, the step counter 103 for counting cross-country skiing steps, the evaluating element 116, and the counter 114 are connected by respective lines to an on/off element 117, which is connected to a power source 118. Depending on the equipment of the ski, the evaluating element 116 can be designed differently.

Figure 1A:
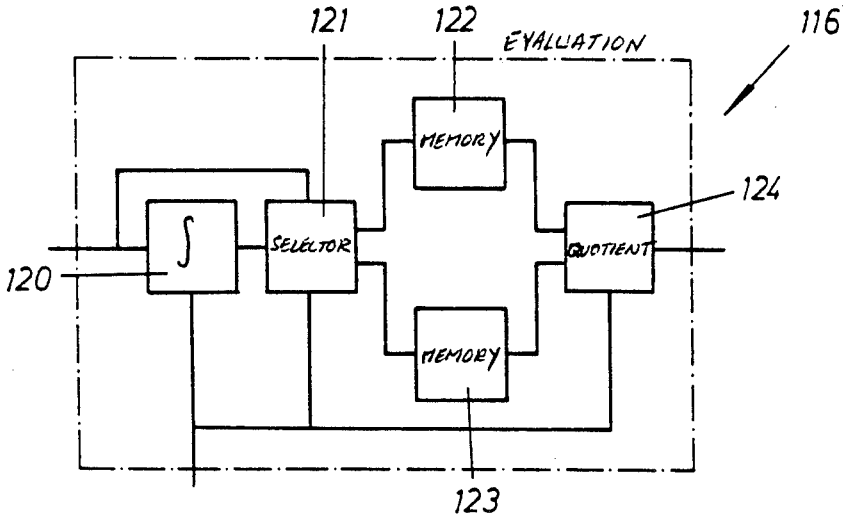
FIGS. 1*a* and 1*b* are block diagrams which respectively show two different embodiments of an evaluating member which is an element of the circuit of FIG. 1.

In particular, referring to FIG. 1*a*, a first embodiment of the evaluating element 116, which is connected to the output of the element 102 for curve analysis, includes an integrator 120 connected to a selector 121, which feeds the integrated values selectively to a third memory 122 or a fourth memory 123. Both memories 122 and 123 are connected to the inputs of a quotient former 124, the output of which leads to the selector 104. The integrator 120, the selector 121 and the quotient former 124 are connected by the on/off element 117 to the power source 118.

Figure 1B:
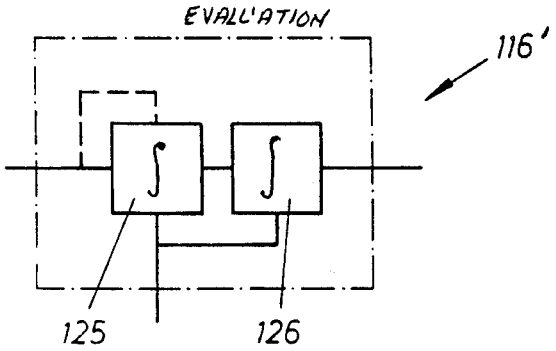

Referring to FIG. 1*b*, a second embodiment 116′ of the evaluating element includes two integrators 125 and 126 which are connected one behind the other, wherein the second integrator 126 is connected to the selector 104. In this embodiment, the two integrators 125 and 126 are each connected by the on/off element 117 to the power source.

Figure 2:
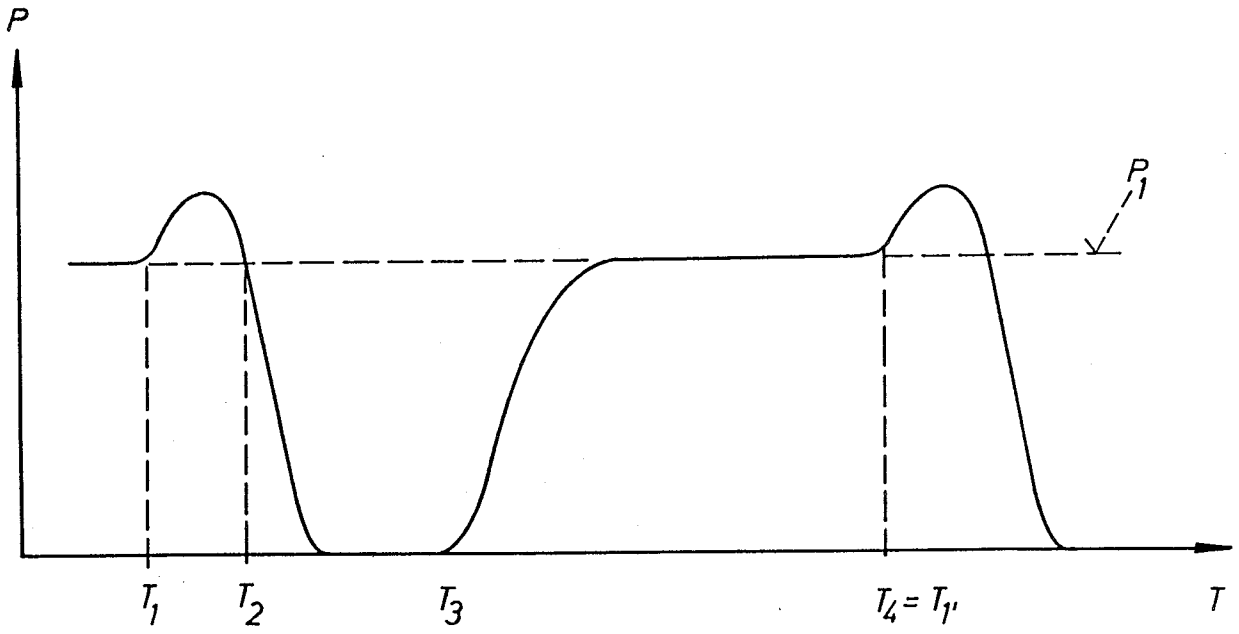
FIG. 2 is a graph which shows as a function of time the pressure applied by a skier to a ski during cross-country skiing.

The pressure P which the skier applies onto the ski over a time period T is plotted in the diagram according to FIG. 2. Between the points in time $T_1$ and $T_2$ there occurs the push-off, and between the points in time $T_3$ and $T_4$ the sliding. The point in time $T_4$ is, at the same time, the start of a new cross-country skiing step $T_1$. $P_1$ identifies the weight of the skier which, during sliding, presses down on the ski.

Figure 2A:
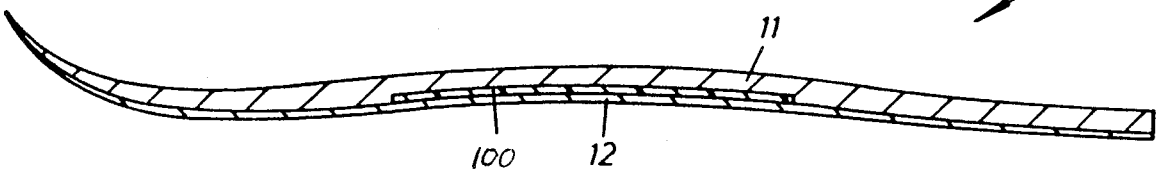
FIG. 2*a* is a longitudinal sectional side view of a ski usable with the circuit of FIG. 1 and having a pressure sensor which is a capacitive pressure plate arranged approximately in the middle third of the ski.
Figure 2B:
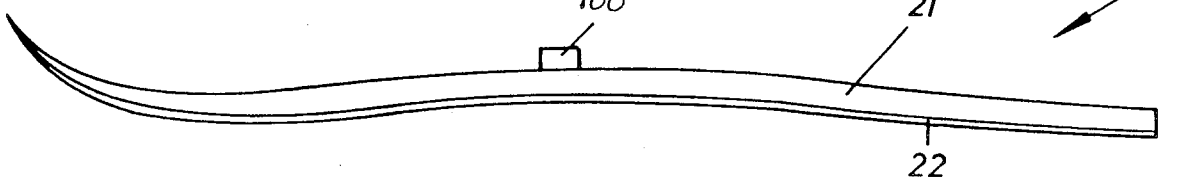
FIG. 2*b* is a side view of a further cross-country ski usable with the circuit of FIG. 1, the upper side of which carries an acceleration pickup.

FIGS. 2*a* and 2*b* illustrate two embodiments of an inventive ski. The ski according to FIG. 2*a* is identified as a whole with reference number 10. It has a ski member 11 and a running coating or base 12. Between the running coating 12 and the ski member 11, approximately in the middle third of the ski 10, there is arranged a sheetlike pressure sensor, namely a capacitive pressure plate 100 which is, for example, made of a rubber-elastic material.

The ski 20 according to FIG. 2*b*, which has a ski member 21 and a running coating 22, is equipped with an acceleration pickup 100, which is arranged on the upper side of the ski.

The operation of the above-described devices is as follows:

First, with the help of the measuring device 100, which can either be the pressure sensor 100 (FIG. 2*a*) provided in the running surface or the acceleration pickup 100′ (FIG. 2*b*) secured on the ski, the changes in pressure applied onto the ski, or alternatively the changes in acceleration of the ski, are measured over a specific time period. The result is calibration curves, which are stored in the buffer memory 101. In the element 102 for curve analysis, there occurs a mathematical determination of the periodicities of the curves, which are each similar to the curve illustrated in FIG. 2, which results in a determination of the step-cycle. If it is necessary for the further evaluation of the curves, it is also possible for the element 102 to determine the points in time $T_1$ to $T_4$ (FIG. 2) which characterize the push-off and sliding phase of a cross-country skiing step. The so determined steps of the skier are counted in the counter 103 until a pregiven step count is reached. Thus, the counter 103 determines those points in time between which the curves stored in the memory 101 are evaluated. The result of one evaluation, following the pregiven number of cross-country skiing steps, reflects the quality of a given adjustment of the ski and is fed through the selector 104 to the memory 105, and the result of the evaluation following the next series of the pregiven number of cross-country skiing steps, which corresponds with the new ski adjustment, is fed to the memory 106, and so forth. The values from the two memories 105 and 106 are compared with one another in the comparison element 102 prior to each new ski adjustment.

From the result of the comparison, the calculator 108 determines whether the last adjustment of the ski brought a good or a poor result for the cross-country skiing behaviour. In dependence thereon, the direction and size of the next adjustment of the ski is determined and the adjusting element 112 is controlled so as to produce such adjustment.

In order to bring the thus effected stepwise optimization of the adjustment of the ski to a meaningful convergence, the on/off element 117 is provided which can turn off power to the control circuit 001 and the measuring device 100, or at least the adjusting element 112, when the counter 114, which registers the number of direction changes of the adjustments, indicates a pregiven number of direction changes has been exceeded. With this, or in a similar manner, the optimizing operation ends automatically when the change of the skiing characteristic of the ski become smaller (through the adjustments by the control circuit becoming smaller and smaller) than the personal skiing fluctuations of the cross-country skier. Of course, it is conceivable in all exemplary embodiments that the optimizing operation can be automatically restarted when the continuously or intermittently operating measuring device and control circuit detect a strong deviation from the optimum value of the last series of measurements. For this purpose, it would be possible to equip the on/off switch 117 with a timer mechanism which automatically turns it on a predetermined interval after it is turned off.

In the embodiment of the evaluating element 116 which is illustrated in FIG. 1*a* and which is used with the ski 10 with a pressure sensor 100 according to FIG. 2*a*, the levels of the changes in pressure which correspond with impulses are evaluated over time in the integrator 120 and are then fed to the selector 121, which stores the impulses of the push-off phase in the memory 122 and the impulses of the sliding phase in the memory 123 (compare the preceding embodiments for FIG. 2). The values are fed from these two memories 122 and 123 to the quotient former 124. The larger the relationship of the impulses during the push-off phase with respect to those during the sliding phase for one cross-country skiing step, or a series of cross-country skiing steps, the more efficient the ski.

If, however, as in FIG. 2*b*, an acceleration pickup 100' is mounted on the ski, then the circuit according to FIG. 1*b* is used. As is known, the integral of acceleration over time is speed and the integral of speed over time is distance traveled, which in this exemplary embodiment is used as criteria for optimizing the adjustment of the ski. In particular, the longer the distance traveled during each cross-country skiing step of the skier, the better the ski corresponds with the demands and skiing style of the skier and the snow and wax conditions. To determine this, the element 102 for the curve analysis is connected to the first integrator 125, which determines speed and is in turn connected to the second integrator 126, which determines distance. A line leads from integrator 126 to the selector 104, which feeds series of, for example ten, cross-country skiing steps of successive different ski adjustments selectively to the memory 105 or the memory 106.

Figure 3:
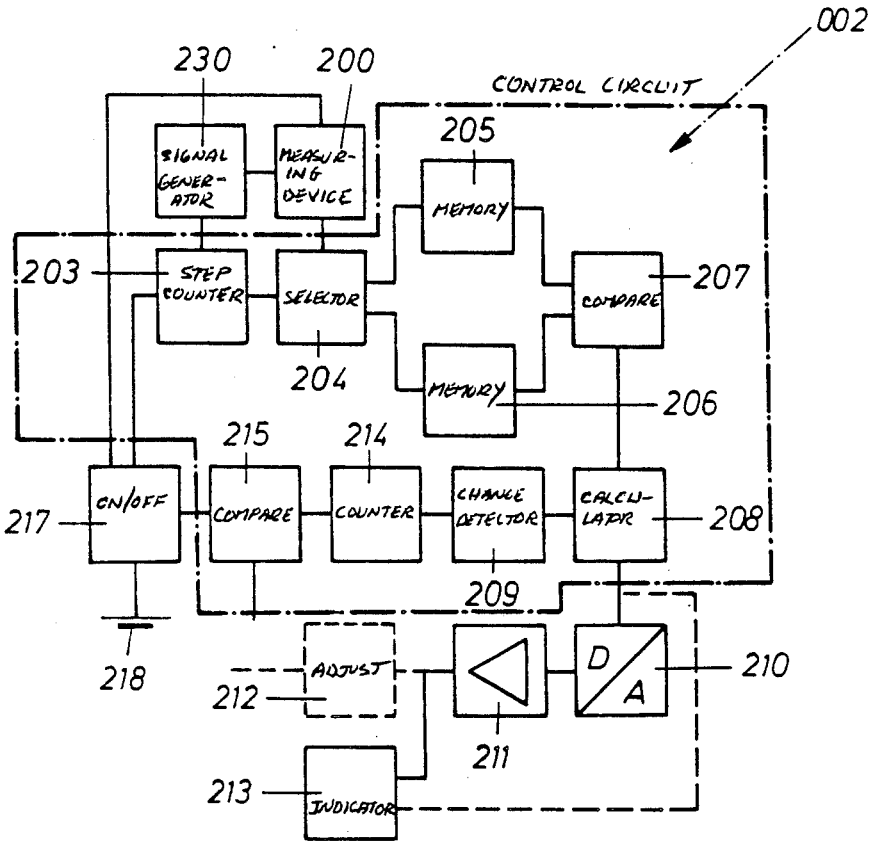
FIG. 3 illustrates a block diagram of a further circuit embodying the invention.

Another embodiment to attain the set purpose is shown in a block diagram in FIG. 3. This embodiment includes, aside from a measuring device 200 which is preferably a timer or clock, an electric signal generator 230, which can preferably be a device operated by the foot of the skier. The measuring device 200 and the signal generator 230 are connected to a control circuit 002. The signal generator 230 is operatively connected on one hand to a counter 203 which counts the number of cross-country skiing steps and on the other hand to the measuring device 200. The use of a separate signal generator 230 makes it possible to do without a buffer memory, an element for curve analysis, and an evaluating element, and to directly derive the time periods of the push-off phase and sliding phase from the movement of the foot of the skier.

The remaining design of this block diagram corresponds substantially with that of FIG. 1. In particular, two memories 205 and 206 are connected to outputs of a selector 204 and to inputs of a comparison element 207, which feeds a result to a calculator 208, to which is connected a digital to analog converter 210. The signals therefrom travel through an amplifier 211 to either an indicating device 213 or an adjusting element 212.

A second line is also connected to the calculator 208 and leads to an element 209 for detecting a change in the direction of adjustment between any two successive adjustments. Element 209 is connected to a counter 214 which counts the number of direction changes and which is in turn connected to a comparison element 215, in which the count of actual direction changes is compared with a predetermined reference count. The elements 200, 203 and 215 are connected through an on/off element 217 to a power source 218.

Figure 4:
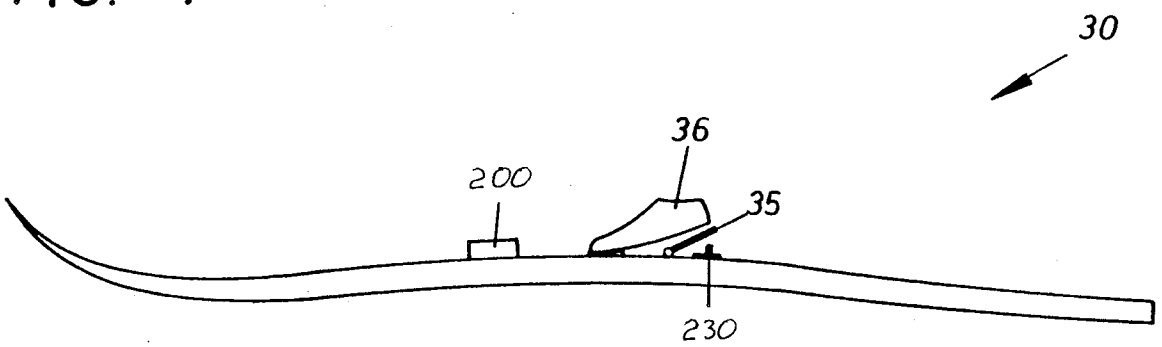
FIG. 4 is a side view of a cross-country ski usable with the circuit of FIG. 3 and having on its upper side a signal generator and a timer.

For the block diagram of FIG. 3, a suitable ski is illustrated in FIG. 4. The ski 30 has on its upper side, below the heel of the ski shoe 36, a pivotable pedal 35. Below the pedal 35 is provided a sensor or signal generator 230. Furthermore, the measuring device 200 in the form of a timer is provided on the ski 30. In this embodiment, the time of, for example, ten cross-country skiing steps serves as a criteria for the ski adjustment optimization: the longer this time is, the stronger the push-off, and the longer in the series the sliding step is, the more efficient the associated ski adjustment for the particular skier.

Figure 5:
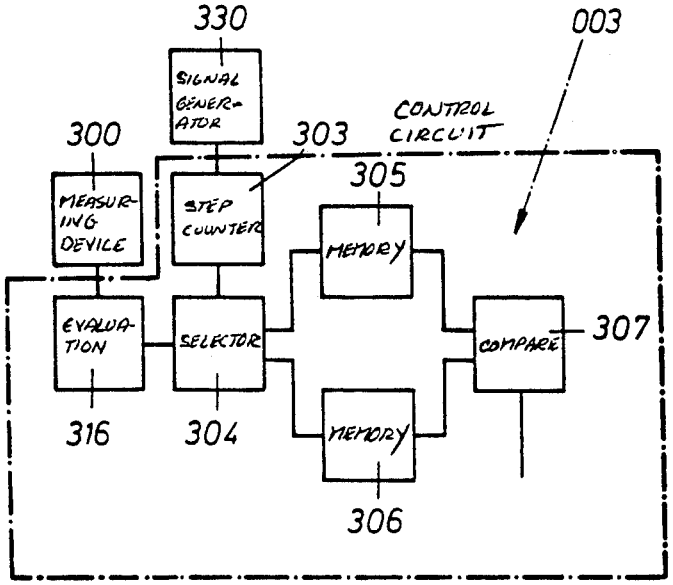
FIG. 5 illustrates a block diagram of a portion of a further circuit embodying the invention and designed for use with the cross-country ski according to FIG. 6 or FIG. 7.

A further block diagram is illustrated in FIG. 5. In this exemplary embodiment, there is a measuring device 300 and a signal generator 330, to which a control circuit 003 is connected. An evaluating element 316 is connected to an output of the measuring device 300 and a counter 303 for counting the number of cross-country skiing steps is connected to an output of the generator 330. From the counter 303 and the evaluating element 316, respective lines lead to a selector 304, to the outputs of which are connected two memories 305 and 306. The outputs of the memories 305 and 306 are connected to the comparison element 307. The output of the comparison element 307 is connected to a circuit arrangement which corresponds with that shown in either FIG. 1 or FIG. 3, so that a more detailed discussion of further details is not needed. The evaluating element 316 is designed to correspond with that shown in either FIG. 1*a* or FIG. 1*b*.

Figure 6:
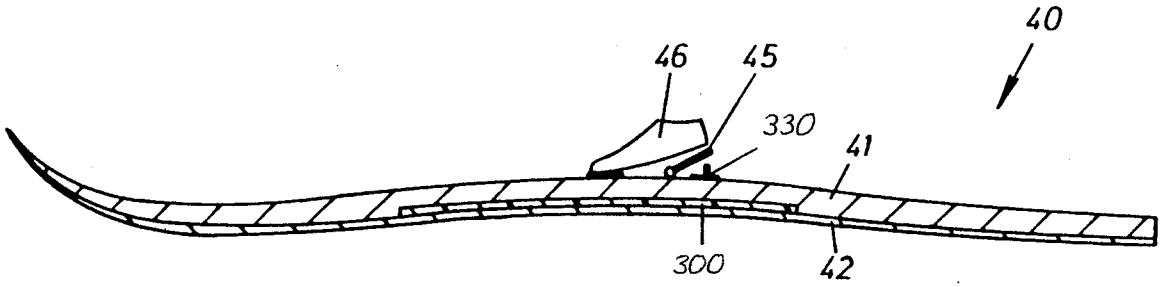
FIG. 6 is a longitudinal sectional side view of a cross-country ski usable with the circuit of FIG. 5 and having on an upper surface thereof an acceleration pickup.

FIG. 6 illustrates a longitudinal sectional view of a ski 40 which, aside from the device 300 being a capacitive pressure plate supported between the ski member 41 and the running coating 42, has the signal generator 330 on its upper side, which generator is operated by movement of a pedal 45 arranged below the heel of the ski shoe 46.

Figure 7:
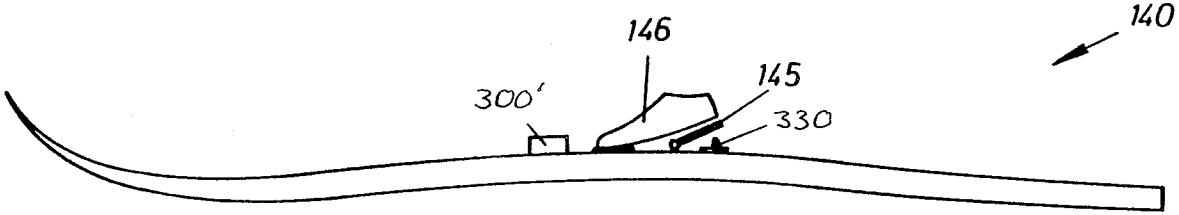
FIG. 7 is a side view of a cross-country ski usable with the circuit of FIG. 5, having a signal generator which can be operated by a foot of the skier, and having a capacitive pressure plate.

The exemplary embodiment according to FIG. 7 differs from FIG. 6 in that the device 300' is an acceleration pickup on the ski 140 in the region of the cross-country ski binding. The remaining construction of the ski 140 corresponds with FIG. 6. It too has a signal generator 330 on the upper side, which generator is operated by a pedal 145 supported pivotally below the heel of the ski shoe 146 on the upper side of the ski.

The step-like and preferably automatic optimization of the adjustment of the ski to meet the demands of a particular cross-country skier occurs, in the last-mentioned embodiments, in the manner already described. The adjustments needed for optimization of the ski can be carried out by hand, semi-automatically, or fully automatically. During manual operation, the adjustment is carried out by the skier according to a value indicated on the indicating device 113 or 213. For semi or fully automatic operation, adjusting mechanisms can be used, some examples of which are illustrated in FIGS. 8 to 13 and described hereinafter.

Figure 8:
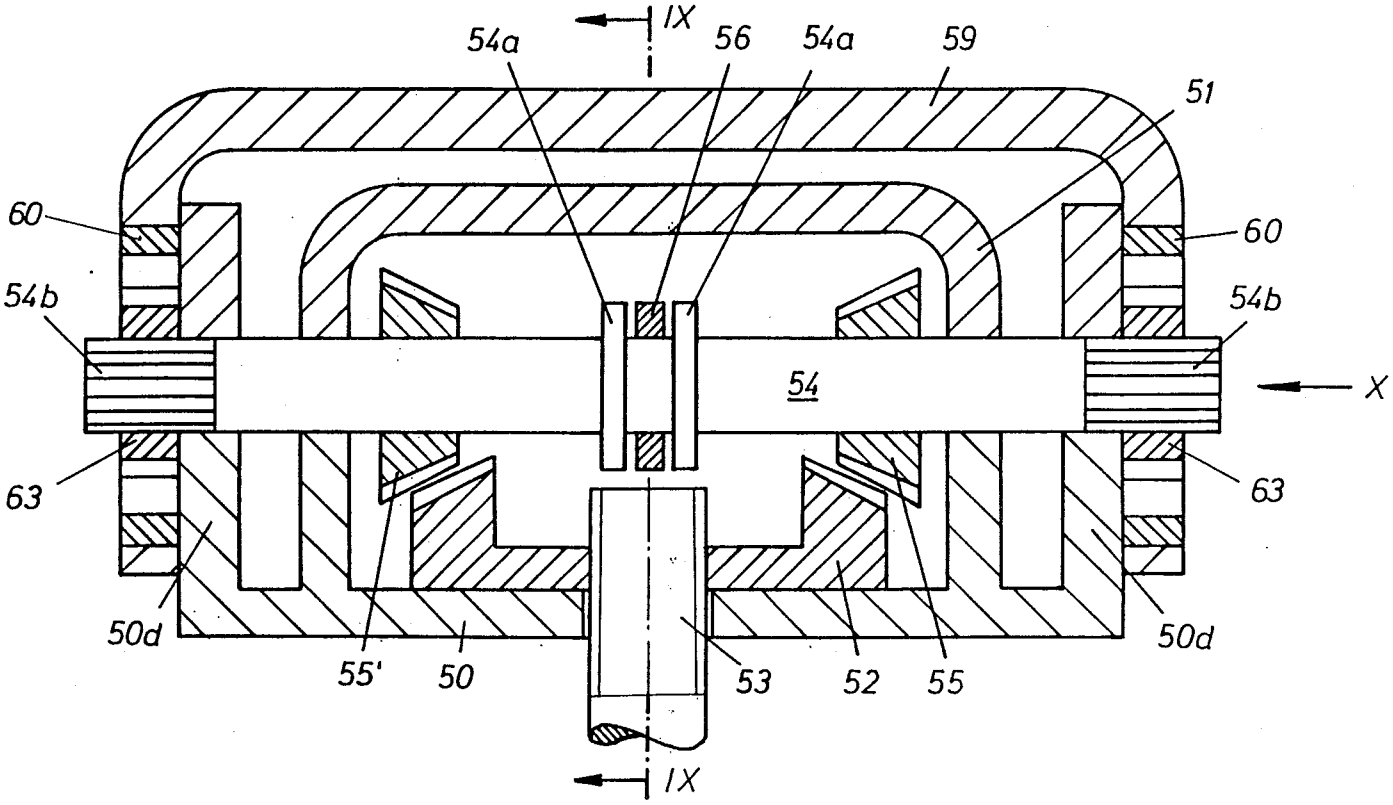
FIGS. 8, 9 and 10 illustrate a gearing mechanism which is utilized for adjusting a cross-country ski, FIG. 8 being a sectional end view taken along the line VIII- —VIII in FIG. 9, FIG. 9 being a sectional side view taken along the line IX—IX in FIG. 9, and FIG. 10 being an end view taken in the direction of the arrow X in FIG. 8.
Figure 8A:
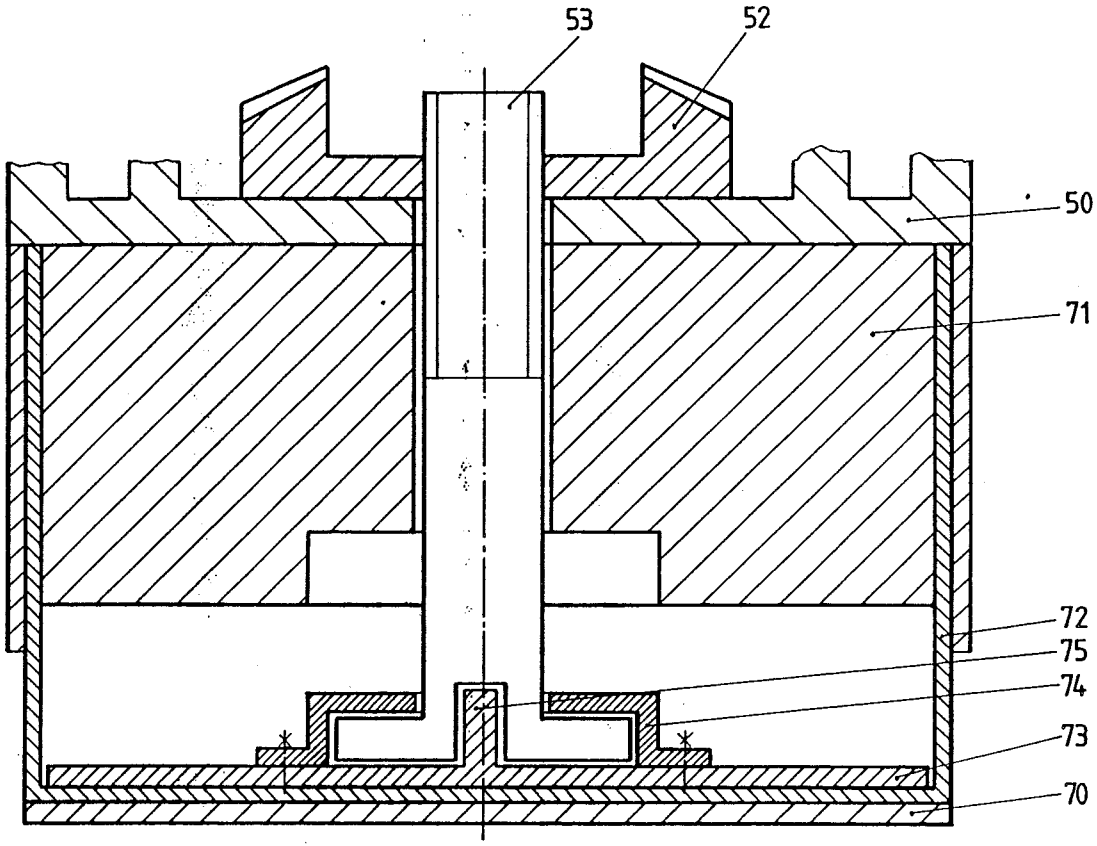
FIGS. 8*a* and 9*a* are respectively a sectional end view and a sectional side view of a ski having thereon the gearing mechanism of FIG. 8, and illustrate a first embodiment of structure operatively connecting the gearing mechanism to the ski, the running surface in the center part of the ski being movable relative to the ski member of the ski.
Figure 8B:
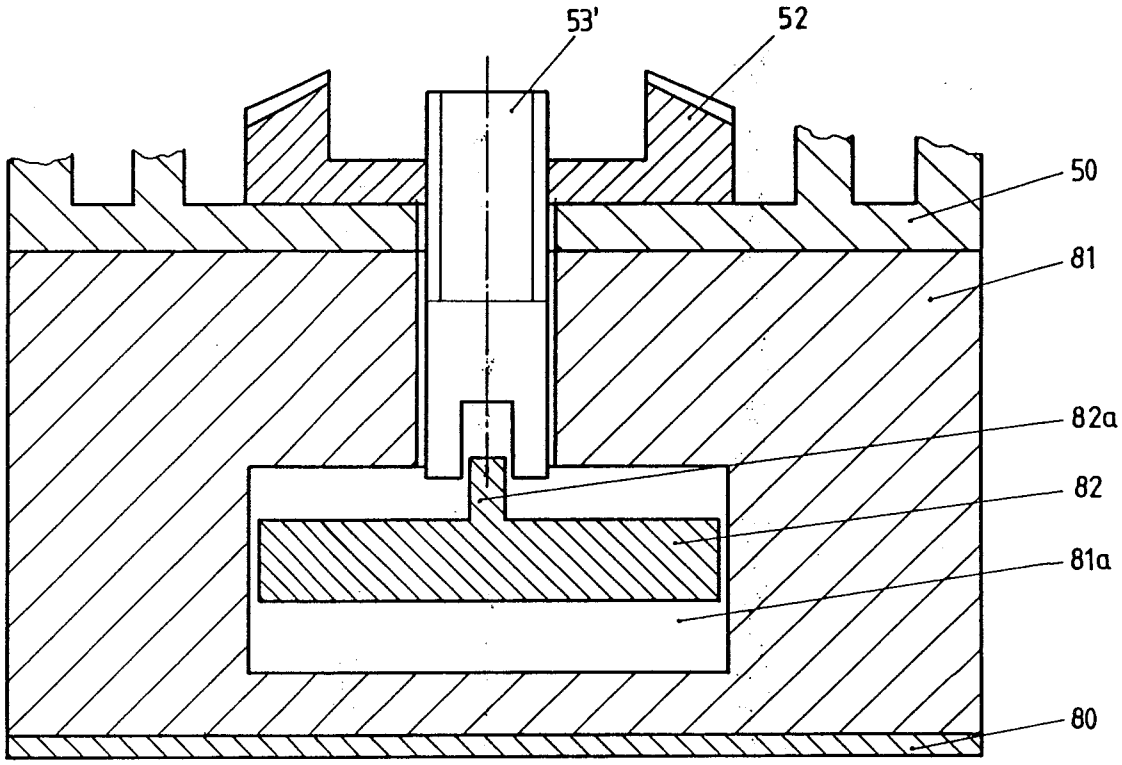
FIGS. 8*b* and 9*b* are respectively a sectional end view and a sectional side view of a ski having thereon the gearing mechanism of FIG. 8, and illustrate a second embodiment of structure operatively connecting the gearing mechanism to the ski, the bending resistance and/or arch of the ski being adjusted by means of a transverse beam which is integrated into the ski.
Figure 9:
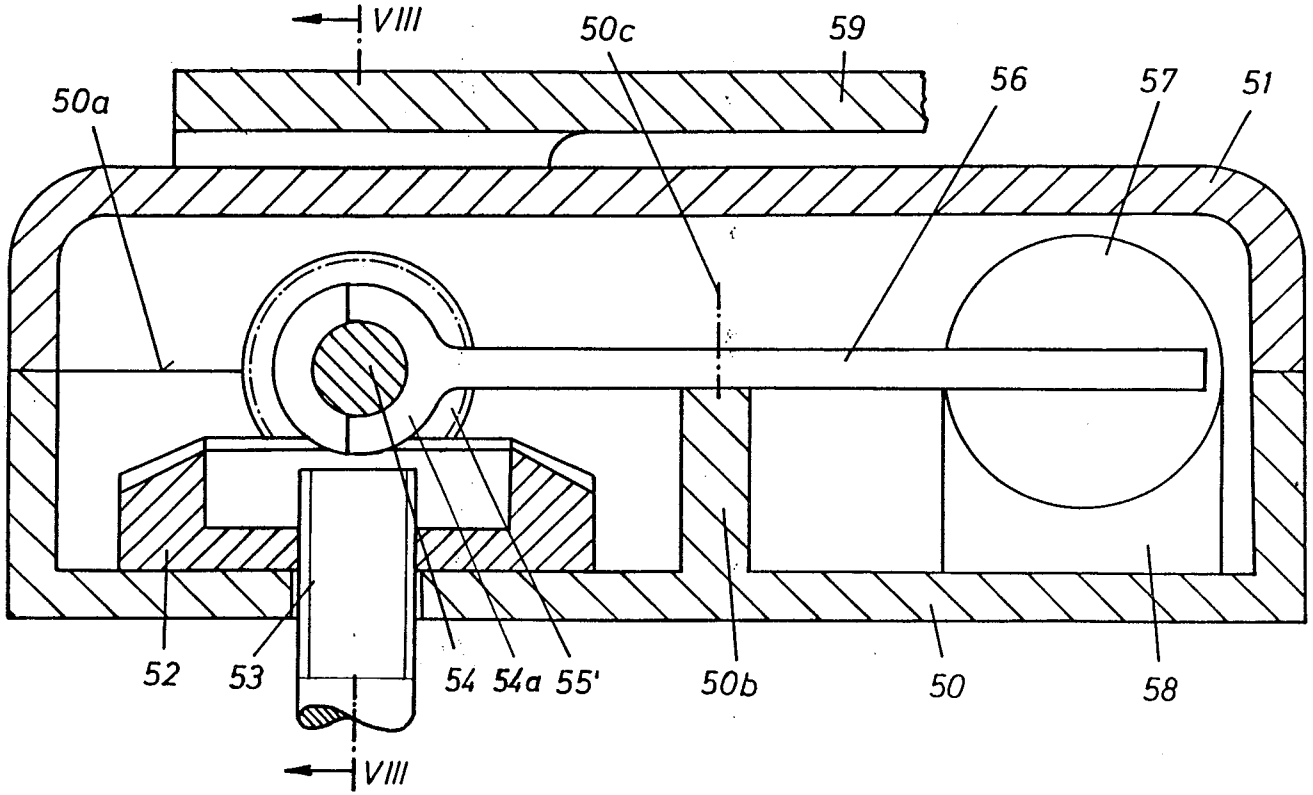
Figure 9A:
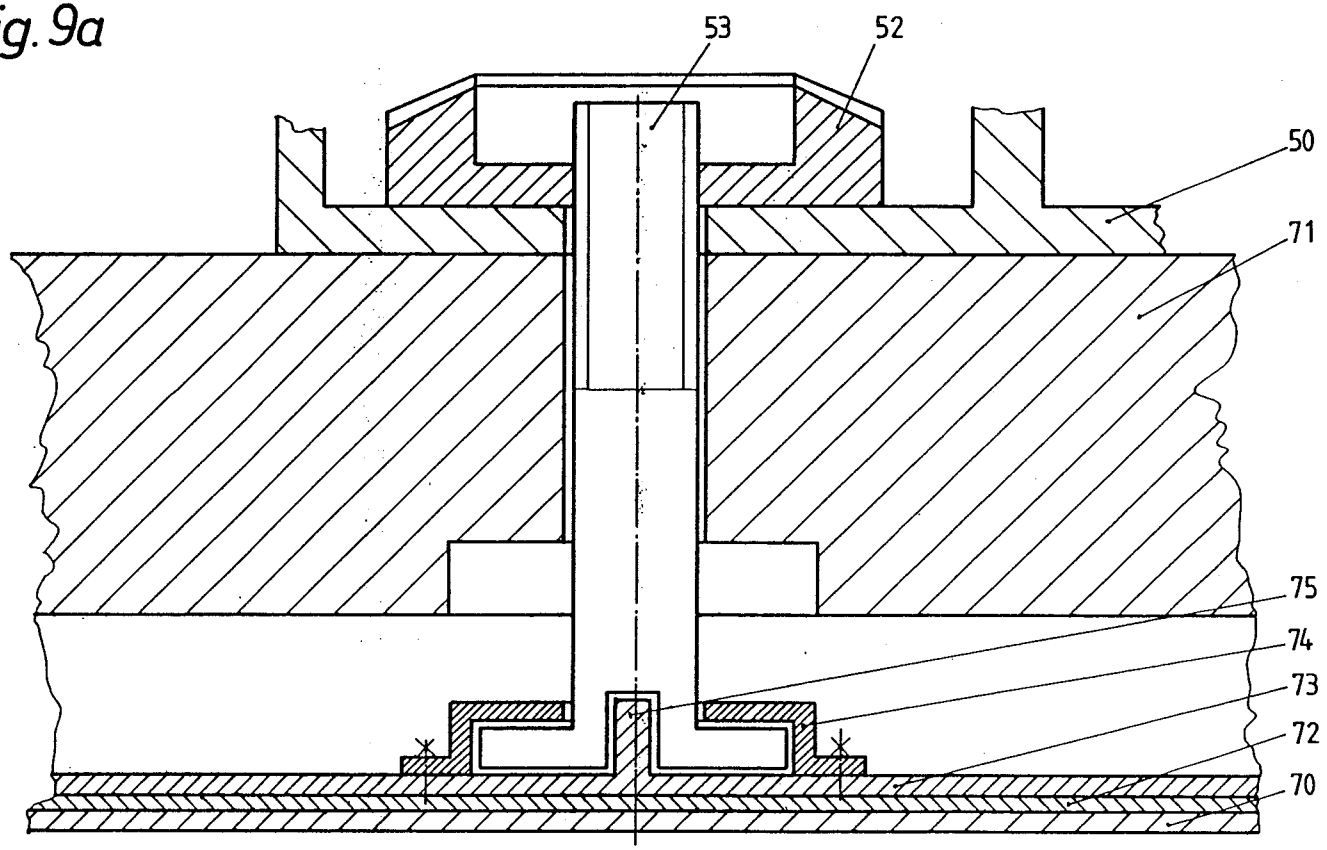
Figure 9B:
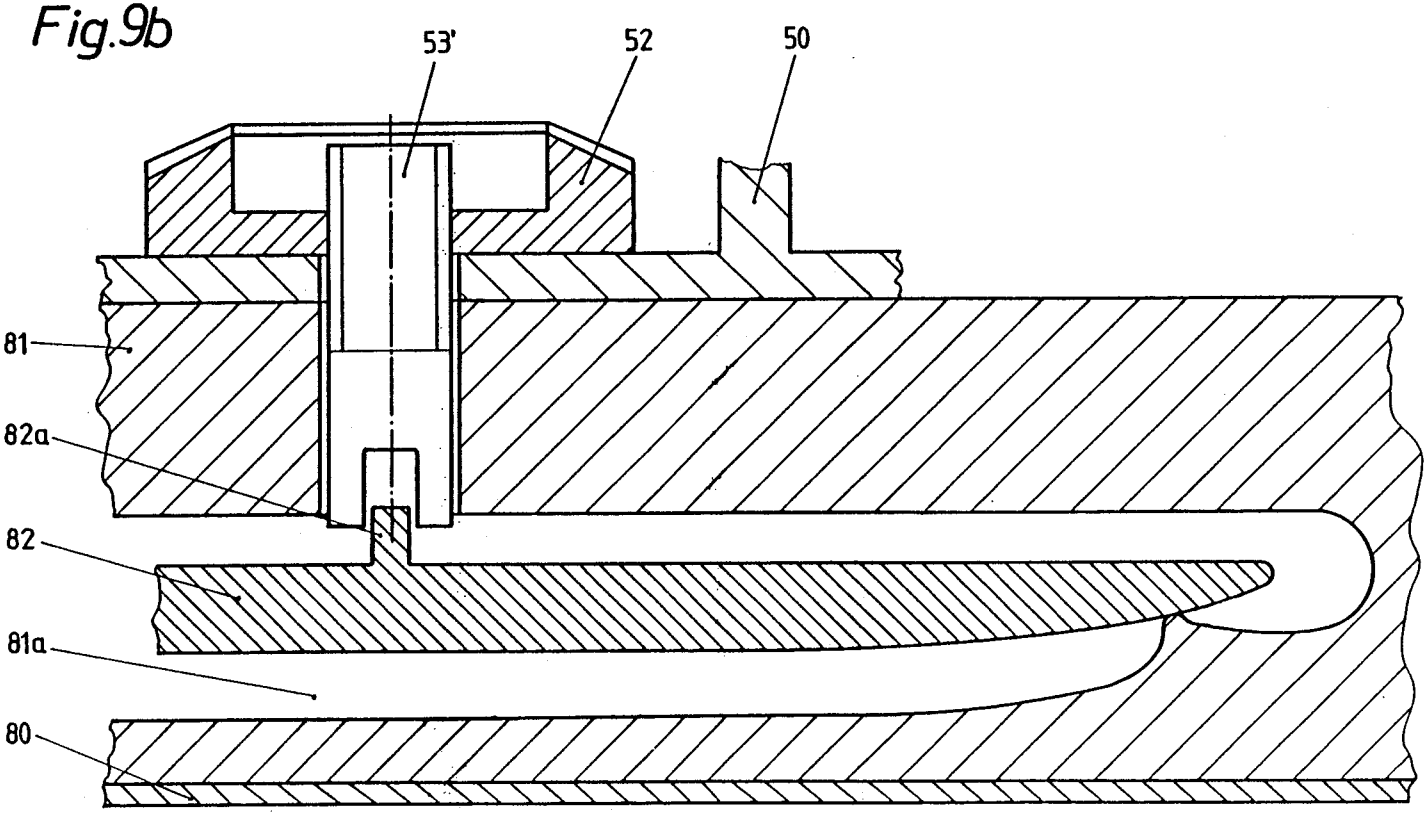
Figure 10:
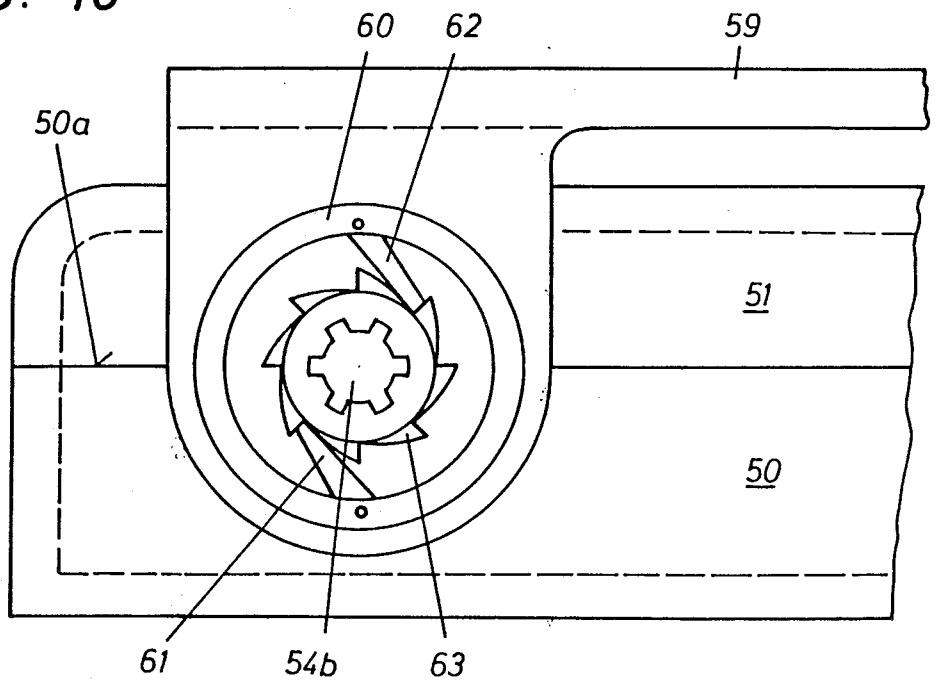

A reversing gear mechanism is illustrated in FIGS. 8 to 10 and has a housing 50 closed by a lid 51. A ring gear 52 is rotatably supported in the housing, which ring gear is provided with an internal thread and effects, through a screw jack 53, the adjustment of the bending resistance or rather arch of the ski (FIGS. 8 and 9). A horizontal shaft 54 is rotatably and axially movably supported in bores in the plane of division **50*a* (FIG. 9) of the housing 50, on which shaft are secured two bevel gears 55 and 55', a respective one of which, during an adjusting operation, is in engagement with the ring gear 52. Two flanges 54*a* are provided in the center of the shaft 54, and between the flanges 54*a* is provided the end of a shift fork 56. The shift fork 56 is supported on a bearing block 50*b* of the housing 50 for pivotal movement about a vertical axis 50*c*. To swing the shift fork 56 in both directions, two solenoids 57 are used, which are secured by bearing blocks 58 on the bottom of the housing 50. The shaft 54** is biased by compression springs which are not illustrated and which tend to constantly hold the shaft in its center position.

The two ends **54*b* of the shaft 54, which project from the housing 50, are constructed like multispline shafts. The ends 54*b* are rotatably supported in bearing blocks 50*d*, which are each an integral piece of the base of the housing 50. A pedal is identified with reference numeral 59, which pedal is biased upwardly by an erecting spring and is shown in its pressed-down position in FIGS. 8–10. It is U-shaped in the region of the shaft 54 (see FIG. 8). Each leg of the pedal 59 carries a bore, into which is inserted a ring 60 (FIG. 10) which pivotally supports two pawls 61 and 62 at its inner side. The pawls 61 and 62 are urged by not-illustrated springs toward the axis of the bore. A ratchet wheel 63 is supported movably on each end 54*b* of the shaft 54 and cooperates with the two pawls 61 and 62**.

FIGS. **8*a* and 9*a* show how, through axial movement of the screw jack 53, the arch of the ski can be adjusted. For this purpose the running coating 50 in the middle third of the ski length is elastically movably connected by a U-shaped rubber membrane 72 to the ski member 71. To reinforce the running coating 70, which can be moved relative to the ski member 71, a platelike reinforcing element 73 is mounted on the bottom wall of the rubber membrane 72. The lower end of the screw jack 53 which extends through the ski member 71 is flange-like and anchored by holding flanges 74 on the reinforcing element 73. The holding flanges 74 are fixedly connected, for example by rivets to the reinforcing element 73. A square pin 75 which slidably extends from the reinforcing element 73 into a square opening in the lower part of the screw jack 53 prevents rotation of the screw jack 53 relative to the element 73 and ski member 71. During rotation of the ring gear 52, this causes the screw jack 53 to move up and down in its axial direction, which results in a corresponding adjustment of the running coating 70 with respect to the ski member 71**.

FIGS. **8*b* and 9*b* illustrate a different embodiment for effecting adjustment, in which a cavity 81*a* is provided inside the ski member 81 having a running coating 60 thereon, in which cavity is a transverse beam 82. The screw jack 53', which is screwed into the internal thread of the ring gear 52 and extends partly through the ski member 81, has at its lower end a square recess which extends in an axial direction. A square pressure rod 82*a* extends upwardly from the transverse beam 82 and slidably engages the square recess, which cases the screw jack 53' to be secured against rotation relative to the ski member 81 and to be adjustable in its axial direction. By controlling the gearing illustrated in FIGS. 8 and 9, the lower end of the screw jack 53' can be adjusted toward and away from the transverse beam 82** and can even be forced against same, which causes the ski to become softer or harder or to change its arch during the skiing operation.

The drive mechanism according to FIGS. 8 and 9 operates as follows. In dependence on the signal which exits from the adjusting element 112 or 212, the shift fork 56 in FIG. 8 is moved either to the right or to the left. Through this, either the left or the right drive bevel gear 55 or 55' engages the ring gear 52. If the pedal 59 is then pressed down by the foot of the cross-country skier, the screw jack 53 coupled to the ring gear 52 is moved upwardly or downwardly, which causes the ski to be adjusted in its bending resistance or arch. This adjustment occurs each time the skier takes a step and presses the pedal 59, until a signal from the adjusting element 112 or 212 indicates no further adjustment is to be carried out. In this case, the current supply to the solenoid 57 which effects movement of the shift fork 56 and shaft 54 is interrupted, and the shaft 54 returns under the influence of its compression spring, which has been compressed, into its normal centered position illustrated in FIG. 8.

From this, it can be recognized that the work which is needed for adjusting the ski is done by the foot of the cross-country skier operating the pedal 59, and that the only power removed from the battery arranged on the ski is the power needed for controlling the gearing.

Figure 11:
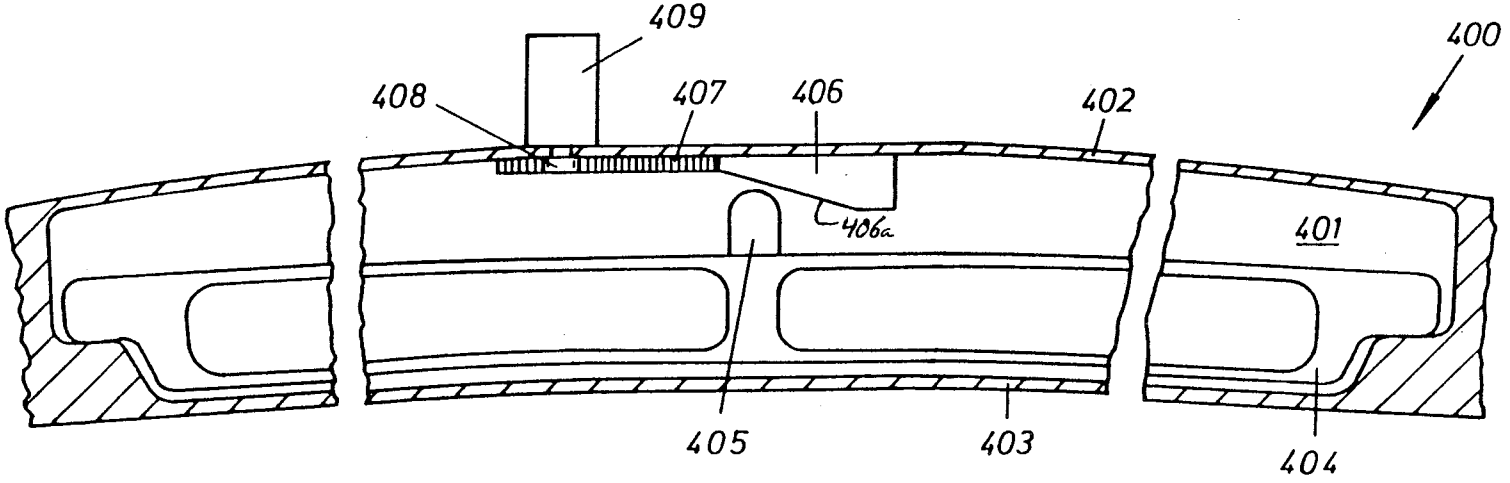
FIGS. 11–13 each illustrate a respective embodiment of a ski having a transverse beam, FIG. 11 being a fragmentary longitudinal sectional side view, FIG. 12 being a fragmentary sectional end view, and FIG. 13 being a sectional end view.
Figure 12:
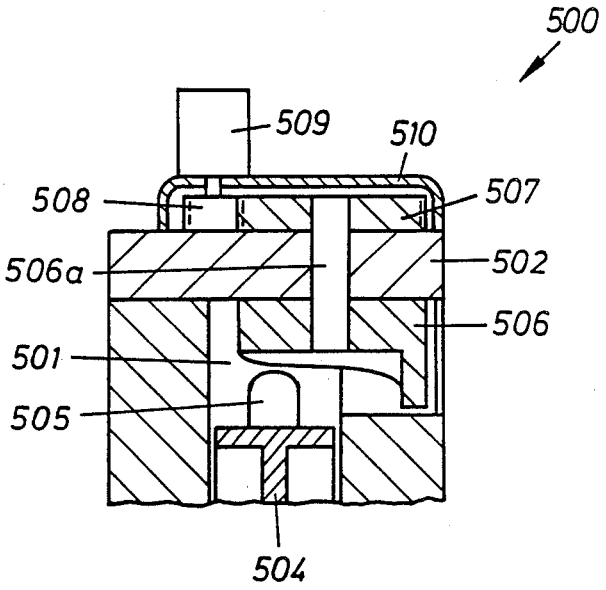
Figure 13:
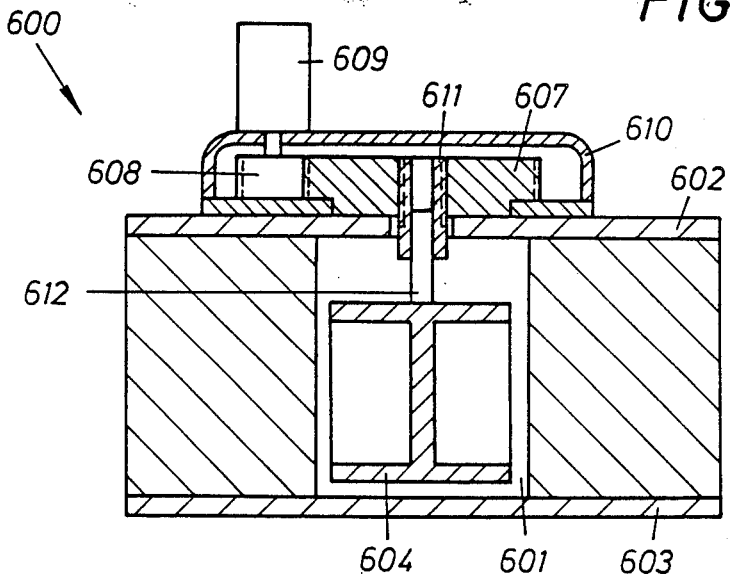

FIGS. 11 to 13 illustrate examples of a fully automatically controlled ski which can be adjusted by an electric motor controlled by the adjusting element 112 or 212. The ski according to FIG. 11, which is illustrated in longitudinal section, is identified in its entirety with reference numeral 400. A cavity 401 is provided inside the ski and is limited at its upper side by an upper belt or wall 402 and at its lower side by a lower belt or wall 403. A transverse beam 404 is provided in cavity 401 and carries on its upper side a pin 405, with which is associated a slide member 406. The latter is equipped with a sloped surface **406*a* and is guided for movement in the longitudinal direction of the ski by not illustrated guide rails provided on the underside of the upper belt 402. The slide member 406 carries a rack 407 on a portion thereof spaced longitudinally from the sloped surface, which rack 407 engages a pinion 408 having a shaft which is rotatably supported in the upper belt 402 and can be driven by an electric motor 409. The distance between the pin 405 and the sloped surface 406***a* of the slide member 406 can be changed, or the sloped surface 406*a* can be moved into engagement with the pin 405 in order to tension the transverse beam 404 with respect to the ski 400, by the controlling electric motor 409.

The ski according to FIG. 12, which is illustrated in section and identified with reference numeral 500, has a cavity 501 therein which is closed off on its upper side by an upper belt or wall 502 and on its underside by a not illustrated lower belt or wall, and a transverse beam 504 is arranged in the cavity and carries a pin 505. Furthermore, a rotary slide member 506 is provided here and carries a screw surface on its underside which is designed to engage the pin 505. The rotary slide member 506 sits on a shaft 506*a* which is rotatably supported in the upper belt 502 and which carries at an upper end thereof, which projects above the upper belt, a gear 507 which mates with a pinion 508. The pinion 508 is secured on the shaft of an electric motor 509. Finally, the gear 507 and the pinion 508 are stored in a housing 510 which is secured on the upper belt 502 in order to protect them against environmental influences.

A similar embodiment of a ski 600 is illustrated in FIG. 13 in section. This ski 600 has a cavity 601 in which a transverse beam 604 is disposed. A housing 610 is again secured on the upper belt 602, which housing 610 carries an electric motor 609. The motor, through a pinion 608, drives a gear 607. Contrary to the preceding exemplary embodiment, however, the bore of the gear 607 is provided with an opening with an internal thread, into which is screwed a hollow threaded bushing 611. The threaded bushing 611 has a square recess which extends in the direction of the bushing axis and in which a pin 612 which is square in cross section is supported movably, the pin 612 being secured on the transverse beam 604. The threaded bushing 611 is in this manner adjustable in an axial direction, but is secured against rotation relative to the ski 600. When the electric motor 609 is switched on, the gear 607 is rotated by the pinion 608, which leads to an axial adjustment of the threaded bushing 611. Through this, it is possible to change the bending resistance of the ski, and by moving the bushing 611 until it tensions the transverse beam, to adjust the arch of the ski 600.

The variable speed gear illustrated in FIG. 13 is driven by the electric motor 609 and can adjust a ski with a running-coating part which can be elastically moved away from the ski member.

Of course, the invention is not limited to the exemplary embodiments which are illustrated in the drawings and described above. Rather, variations and modifications thereof, including the rearrangement of parts, are possible without leaving the scope of protection. For example, the sheetlike pressure sensor illustrated in FIG. 2*a* can be replaced with one or more dot-shaped pressure sensors. Furthermore, the measuring device according to FIGS. 3 and 4, which is designed as a clock, can also be provided as a part of the control circuit, for example by using the timing element which is already provided in the control circuit to simultaneiously measure the decisive time period. Finally, the pedal and sensor could also be arranged in the region of the ball of the ski shoe in each of the three embodiments according to FIGS. 4, 6 and 7.

The embodiments of the invention in which an exclusive property or privilege is claimed are defined as follows:

1. An apparatus comprising a cross-country ski having a bending resistance and arch, one of said bending resistance and arch being adjustable, an electronic control circuit which is powered by a power source and is connected to at least one measuring device, said control circuit producing an output representing an adjustment to be made to said one of said bending resistance and arch, and means for facilitating adjustment of said one of the bending resistance and arch of the ski as a function of said output of said control circuit; including a signal generator which is connected to an input of said control circuit, and wherein said control circuit includes a counter coupled to an output of one of the measuring device and the signal generator, in which counter an adjustable number of cross-country skiing steps is counted.

2. The apparatus according to claim 1, wherein the measuring device is a timer which receives from a signal generator impulses defining the duration of a measurement.

3. The apparatus according to claim 1, wherein the signal generator to an input of said control circuit, is operated by the foot of the skier and produces an output signal which at a given point in time is in one of an "on" and an "off" state.

4. The apparatus according to claim 1, wherein the signal generator is one of a photoelectric device and an induction switch.

5. The apparatus according to claim 1, wherein said signal generator is operated by a foot of a skier; wherein the measuring device is a timer which receives impulses defining the duration of measurement from the signal generator; and wherein said means for facilitating adjustment includes a drive mechanism, and an adjusting mechanism in the ski which adjusts said one of said bending resistance and arch and which is driven by the drive mechanism.

6. The apparatus according to claim 1, wherein said signal generator is operated by a foot of a skier; wherein the measuring device is one of a pressure senosr arranged in the region of a running surface of the ski and an acceleration pickup; and wherein said means for facilitating adjustment includes a drive mechanism, and an adjusting mechanism in the ski which adjusts said one of said bending resistance and arch and which is driven by the drive mechanism.

7. The apparatus according to claim 1, wherein said control circuit includes a selector, and includes two memories which are coupled by the selector to an output of the counter, in which memories respective measured values representing two successive series of cross-country skiing steps are selectively stored.

8. The apparatus according to claim 7, wherein the outputs of both memories are connected to a comparison element which is in turn coupled to said means for facilitating adjustment.

9. The apparatus according to claim 8, wherein said comparison element is coupled through a digital to analog converter and an amplfiier to said means for facilitating adjustment of said one of said bending resistance and arch.

10. An apparatus comprising a cross-country ski having a bending resistance and arch, one of said ending resistance and arch being adjustable, an electronic control circuit which is powered by a power source and is connected to at least one measuring device, said control circuit producing an output representing an adjustment to be made to said one of said bending resistance and arch, and means for facilitating adjustment of said one of the bending resistance and arch of the ski as a function of said output of said control circuit; wherein said control circuit includes an evaluating element which is coupled to an output of the measuring device, and which includes an integrator.

11. The apparatus according to claim 10, wherein the measuring device is a pressure sensor arranged in the region of the running surface of the ski.

12. The apparatus according to claim 10, wherein the measuring device is an acceleration pickup.

13. The apparatus according to claim 10, wherein said means for facilitating adjustment includes an electric motor which is powered by a battery, is arranged on the upper side of the ski and has a shaft which carries a pinion.

14. The apparatus according to claim 10, wherein said evaluating element includes two memories and a selector which can supply an output of said integrator to an input of a selected one of said memories.

15. The apparatus according to claim 10, wherein asid evaluation element includes a further integrator connected in series with said first-mentioned integrator.

16. The apparatus according to claim 10, wherein said means for facilitating adjustment includes drive means responsive to said output of said control circuit for effecting a corresponding adjustment in said one of said bending resistance and arch of said ski.

17. The apparatus according to claim 1, wherein the measuring device is a capacitive pressure plate arranged in the middle third of the running surface of the ski.

18. The apparatus according to claim 11, wherein said measuring device includes at least one dot-shaped sensor which is provided in the region of t he middle third of the running surface of the ski.

19. The apparatus according to claim 13, wherein the pinion mates with a rack rigidly connected to a slide member having a sloped surface, said slide member being movably supported on an underside of an upper belt of the ski by guide rails.

20. The apparatus according to claim 13, wherein the pinion mates with a gear secured on a drive shaft of a rotary slide member having on its underside a screw surface.

21. The apparatus according to claim 13, wherein the pinion mates with a gear having an axial bore which carries a thread, into which bore is screwed a bushing which is held against rotation relative to the ski and which can positionally adjust a transverse beam arranged in a cavity in the ski.

22. The apparatus according to claim 21, wherein a square rod projects vertically upwardly from the transverse beam and extends into a square bore provided in the bushing.

23. The apparatus according to claim 13, wherein the pinion mates with a gear having a threaded axial bore, into which is screwed the end of a bolt having its lower end anchored in a running coating of the ski which, approximately in the middle third of the ski, can be moved toward and away from a ski member of the ski.

24. The apparatus according to calim 14, wherein the selector connected to the integrator feeds an inpulse produced by the skier during the push-off phase to one of the memories and feeds an impulse produced during the sliding phase to the other memory.

25. The apparatus according to claim 24, wherein a quotient forming element is connected to outputs of the two memories and forms the quotient of two impulses respectively corresponding to the push-off phase and sliding phase.

26. The apparatus according to claim 24, wherein said control circuit includes a further selector and two further memories, and wherein an output of the quotient forming element is connected by the further selector to the further memories.

27. An apparatus comprising a cross-country ski having a bending resistance and arch, one of said bending resistance and arch being adjustable, an electronic control circuit which is power by a power source and is connected to at least one measuring device, said control circuit producing an output representing an adjustment to be made to said one of said bending resistance and arch, and means for facilitating adjustment of said one of the bending resistance and arch of the ski as a function of said output of said control circuit; wherein said means for facilitating adjustment includes a drive mechanism which effects adjustment of said one of said bending resistance and arch and which is driven by a pedal movably supported thereon, said pedal being operated by a skier when taking a step.

28. The apparatus according to claim 27, wherein said drive mechanism includes at least one ratchet wheel which couples said pedal to an axially movable shaft of a reversible gearing mechanism, said gearing mechanism including two bevel gears supported on the shaft and one ring gear threadedly coupled to a screw jack, and wherein the axially movable shaft is resiliently urged toward a center position by means of compression springs, in which center position neither of the two bevel gears engage the ring gear.

29. The apparatus according to claim 28, wherein the screw jack, at its end nearest a running surface of the ski, has a flange which is anchored by holding flanges on a reinforcing element of a running coating of the ski, and wherein the screw jack is nonrotatable relative to the ski but is movable in an axial direction.

30. The apparatus according to claim 28, wherein the screw jack is secured against rotary movement relative to the ski but is guided movably in an axial direction and forms a guideway and a stop for a transverse beam at its end nearest the running surface of the ski, which transverse beam is provided in a cavity in the ski.

31. The apparatus according to claim 28, wherein the gearing mechanism includes a movably supported shift fork, and wherein the shaft of the reversible gearing mechanism carries two flanges, between which is arranged an end of the shift fork.

32. The apparatus according to claim 31, wherein the shift fork can be pivoted in respective directions by two solenoids arranged in a housing of the reversible gearing mechanism.

33. The apparatus according to claim 28, wherein the ring gear carries an integral drive shaft which has at its lower end a gear which mates with a rack provided on a side member, said slide member being movable in the longitudinal direction of the ski and movement thereof effecting adjustment of said one of said bending resistance and arch.

34. The apparatus according to claim 30, wherein a square rod projects vertically upwardly from the transverse beam and extends into a square bore provided in the screw jack.

35. An appartus comprising a cross-country ski having a bending resistance and arch, one of said bending resistance and arch being adjustable, an electronic control circuit which is powered by a power source and is connected to at least one measuring device, said control circuit producing an output representing an adjustment to be made to said one of said bending resistance and arch, and means for facilitating adjustment of said one of the bending resistance and arch of the ski as a function of said output of said control circuit; wherein the control circuit includes an element for curve analysis; wherein the measuring device is one of a pressure sensor arranged in the region of a running surface of the ski and an acceleration pickup; wherein the control circuit includes a counter coupled to an output of the measuring device, in which counter an adjustable number of cross-country skiing steps is counted; and wherein said means for facilitating adjustment includes a drive mechanism, and an adjusting mechanism in the ski which adjusts said one of said bending resistance and arch and which is driven by the drive mechanism.

36. An apparatus comprising a cross-country ski having a bending resistance and arch, one of said bending resistance and arch being adjustable, an electronic control circuit which is powered by a power source and is connected to at least one measuring device, said control circuit producing an output representing an adjustment to be made to said one of said bending resistance and arch, and means for facilitating adjustment of said one of the bending resistance and arch of the ski as a function of said output of said control circuit; wherein aid means for facilitating adjustment includes an indicating device which is coupled to said output of said control circuit and which provides a visual representation of said adjustment to be made to said one of said bending resistance and arch, and includes manually actuatable means for facilitating manual adjustment of said one of said bending resistance and arch of said ski.

* * * * *

UNITED STATES PATENT AND TRADEMARK OFFICE

CERTIFICATE OF CORRECTION

PATENT NO. : 4 740 009

DATED : April 26, 1988

INVENTOR(S) : Klaus HOELZL

It is certified that error appears in the above-identified patent and that said Letters Patent is hereby corrected as shown below:

Column 10, Line 25; After "generator" insert ---is connected---.

Column 10, Line 43; Change "senosr" to ---sensor---.

Column 10, Line 62; Change "amplfiier" to ---amplifier---.

Column 10, Line 66; Change "ending" to ---bending---.

Column 11, Line 32; Change "Claim 1" to ---Claim 11---.

Column 11, Line 64; Change "calim" to ---claim---.

Column 11, Line 65; Change "inpulse" to ---impulse---.

Column 12, Line 6; Change "Claim 24" to ---Claim 25---.

Column 12, Line 61; Change "side" to ---slide---.

Column 14, Line 12; Change "aid" to ---said---.

Signed and Sealed this

Twenty-seventh Day of September, 1988

*Attest:*

DONALD J. QUIGG

*Attesting Officer*

*Commissioner of Patents and Trademarks*